US005695044A

United States Patent [19]

Morikiyo et al.

[11] Patent Number: 5,695,044

[45] Date of Patent: Dec. 9, 1997

[54] PUSHER CONVEYOR HAVING PUSHER DOG WITH RETAINER

[75] Inventors: Akira Morikiyo, Tokorozawa; Koichi Mizuguchi, Higashiyamato; Susumu Kawano, Iruma; Kenji Umezawa, Tokorozawa; Isao Takatori, Kawagoe, all of Japan

[73] Assignee: Tsubakimoto Chain Co., Osaka, Japan

[21] Appl. No.: 500,203

[22] Filed: Jul. 10, 1995

[30] Foreign Application Priority Data

Jul. 12, 1994 [JP] Japan ..... 6-181967

[51] Int. Cl.[6] ..... B65G 25/10

[52] U.S. Cl. ..... 198/746; 198/732; 198/740; 104/162

[58] Field of Search ..... 198/732, 740, 198/746; 104/162

[56] References Cited

U.S. PATENT DOCUMENTS

| | | | |
|---|---|---|---|
| 2,575,396 | 11/1951 | Schenk | 104/162 |
| 3,202,115 | 8/1965 | Jones | 198/740 |
| 3,260,220 | 7/1966 | Ludwig | 104/162 |
| 4,318,660 | 3/1982 | Checkley et al. | 104/162 |

FOREIGN PATENT DOCUMENTS 58-26862 6/1983 Japan .

*Primary Examiner*—Joseph E. Valenza

*Attorney, Agent, or Firm*—Armstrong, Westerman, Hattori, McLeland & Naughton

[57] ABSTRACT

A retainer dog is pivotally mounted on a pusher dog at the front end portion thereof and normally urged to a standing position. The distance between a retainer surface of the retainer dog and a thrust surface of the pusher dog is predetermined such that a space large enough for the retainer dog to rotate with a tilting radius can be obtained.

2 Claims, 4 Drawing Sheets

PUSHER CONVEYOR HAVING PUSHER DOG WITH RETAINER

FIELD OF THE INVENTION

The present invention relates generally to pusher conveyors and more particularly, to a thrust pusher conveyor preferably for conveying a conveyor truck to a traverse.

BACKGROUND OF THE INVENTION

As shown in FIG. 4, a conventional thrust pusher conveyor includes a pusher dog P, mounted on a reciprocating conveyor chain C, for thrusting a conveyor truck A in the direction of the arrow by engaging with a thrust pusher engaging plate B vertically elongated downward from a lower surface of a rear portion of the conveyor truck A.

The foregoing pusher dog P is pivotally mounted on the conveyor chain C and by means of a weight, a spring and the like, wherein when the conveyor truck A moves in a direction from the rear to the front, the pusher dog P is tilted frontward so that the conveyor truck A is allowed to pass therethrough.

when the pusher dog P, moving in a direction of the arrow, thrusts the conveyor truck A by engaging with the thrust pusher engaging plate B of the stopping conveyor truck A, the pusher dog P collides with the stopping thrust pusher engaging plate B. The shock of the collision pushes forth, away from the pusher dog P, overruns and stops the thrust pusher engaging plate B, which, in turn, collides with the following pusher dog P and overruns several times. For this reason, a retainer dog S is mounted on the conveyor chain C in order to prevent.: (1) the overrunning of the thrust pusher engaging plate B; (2) reiterated collision shock between the thrust pusher engaging plate B and the pusher dog P; and (3) pulsating start of the conveyor truck and overrunning thereof.

The retainer dog S is pivotally mounted, facing and positioned at certain intervals from the pusher dog P, on the conveyor chain C and normally urged to a standing position, being capable of tilting toward the side of the pusher dog P against the urging force.

The pusher dog P and the retainer dog S must be placed apart from each other such that an appropriate space is obtained therebetween in order for the dogs P and S not to interfere with each other when they tilt at the same time According to the aforementioned pusher conveyor, the distance between the pusher dog P and the retainer dog S is large enough to raise the problem that the interval therebetween is elongated when both the pusher dogs P and the retainer dogs S are in standing positions. Thus, the overrunning distance of the thrust pusher engaging plate B is extended, as mentioned above, with the result that the collision shock becomes larger and the pulsatile start is intensified. Further, the stop position of the truck is inaccurate.

SUMMARY OF THE INVENTION

In view of the foregoing problems, inherent in the known type of pusher conveyor, the preferred embodiment of the present invention provides a pusher conveyor having a pusher dog with a retainer which includes a conveyor chain; a pusher dog pivotally mounted on the conveyor chain, the pusher dog having a thrust surface and a front end portion; a retainer dog pivotally mounted on the pusher dog at the front end portion thereof and normally urged to a standing position, the retainer having a retainer surface, wherein the retainer surface normally faces to the thrust surface at a distance.

More particularly, according to a preferred embodiment of the present invention the pusher conveyor having a pusher dog with a retainer further includes a cam roller on said pusher dog swinging said pusher dog; a forward standing rail for guiding the cam roller in a frontward direction; a backward prostrate rail for guiding the cam roller in a backward direction; and switch rails for switching the moving direction of the cam roller from frontward to backward direction and from backward to frontward direction at a retreat limit and an advance limit of the pusher dog, respectively, whereby the tilting posture of the pusher dog is changed.

When constructed according to the present invention and as described above, the retainer dog rotates together with the pusher dog when the pusher dog tilts so that the distance between the thrust surface of the pusher dog and the retainer surface of the retainer dog is not changed. Meanwhile, the distance therebetween becomes reduced only when the retainer dog is tilted toward the thrust surface of the pusher dog by an external force. Accordingly, in order to avoid the mutual interference between the retainer dog and the pusher dog, it is only necessary that the distance between the thrust surface and the retainer surface be a space large enough to accommodate the retainer dog's rotation with a tilting radius.

DETAILED DESCRIPTION OF THE PREFERRED EMBODIMENT

The preferred embodiment of the present invention will now be described in detail with reference to the accompanying drawings.

Figure 1:
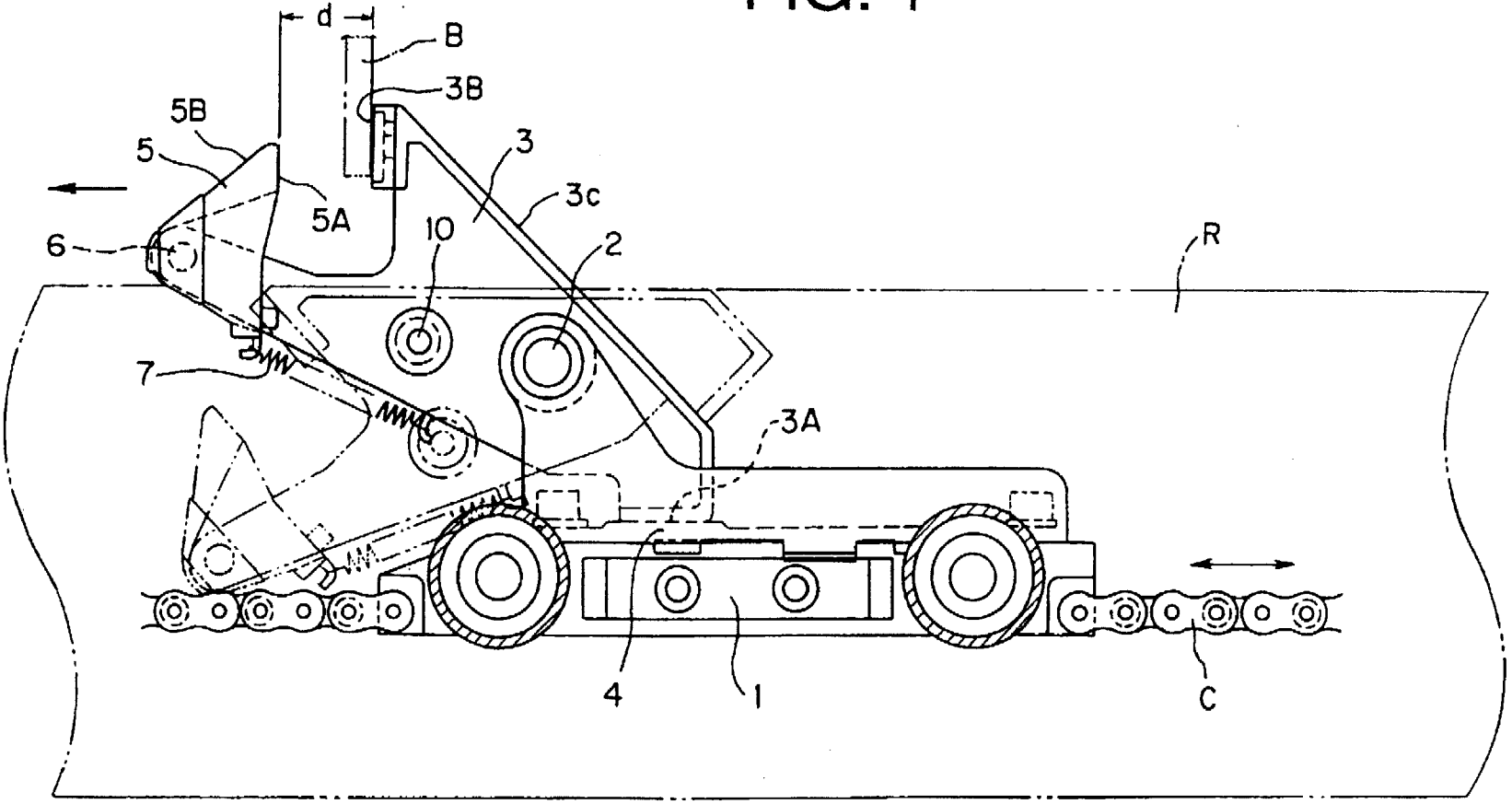
FIG. 1 is an enlarged fragmentary front view of an embodiment of a pusher conveyor having a pusher dog with a retainer according to the present invention.

FIG. 1 is an enlarged fragmentary front view of the preferred embodiment of a pusher conveyor having a pusher dog with a retainer according to the present invention.

As shown in FIG. 1, a pusher dog 3 is pivotally mounted, by a pivotal shaft 2, on a mount body 1 which is connected to a reciprocating drive chain C, wherein the pusher dog 3 rotates from a standing position illustrated by solid lines to a prostrate position illustrated by phantom or dashed lines, and vice versa. The aforementioned standing position is restricted such that a lower end portion 3A of the pusher dog 3 abuts a stopper 4 of the mount body 1, with the result that a thrust surface 3B formed at an upper end portion of the pusher dog 3 is maintained at a position where the thrust surface 3B is engaged with a pusher engaging plate B of a conveyor truck A.

A retainer dog 5 is pivotally mounted, by a pivotal shaft 6, on the pusher dog 3 at the front end portion thereof and normally urged to a standing position by a spring 7, such that a retainer surface 5A of the retainer dog 5 is maintained by a stopper (not shown) at which the retainer surface 5A and the thrust surface 3B of the pusher dog 3 are facing each other at a distance.

Further, the mounting position of the pivotal shaft 2 is determined such that the back surface 3C of the pusher dog 3 sinks under an upper surface of a running guide rail R when the pusher dog 3 is tilted to a position illustrated by phantom or dashed lines.

The external thrust force against the back surface 5B of the retainer dog 5 makes the retainer dog 5 tilt toward the side of the thrust surface 3B of the pusher dog 3.

Constructed as described above, when the pusher dog 3 approaches the stopping conveyor truck, the pusher dog engaging plate B abuts against and pushes down the back surface 5B of the retainer dog 5 so that the retainer dog 5 is tilted backward, thereby allowing the pusher dog engaging plate B to pass over the retainer dog 5 and abut against the thrust surface 3B of the pusher dog 3 at a position as illustrated by phantom or dashed lines. While, the retainer dog 5 regains the standing position, as illustrated by solid lines, from the prostrate position, at which the pusher dog engaging plate B passes over the retainer dog 5 without colliding therewith. In this way, even though the conveyor truck runs toward the retainer dog 5, by means of the repulsive force of the thrust surface 3B of the pusher dog 3 against the pusher dog engaging plate B, and collides with the retainer surface 5A of the retainer dog 5, it is only necessary to obtain a space large enough so that the retainer dog 5 can rotate with a tilting radius which is not more than the distance d between the thrust surface 3B and the retainer surface 5A. Because the foregoing distance d is much smaller than that of the aforementioned conventional example, reciprocating pulsation phenomenon caused between the thrust surface 3B and the retainer surface 5A can be rapidly reduced.

Figure 2A:
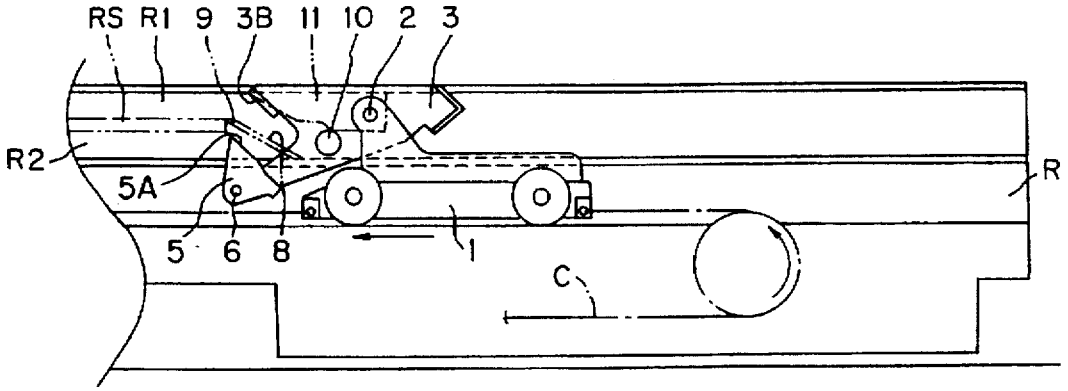
FIGS. 2 (A) and (B) are fragmentary front views of a reciprocating guide rail of the pusher dog as shown in FIG. 1 which are useful in explaining the operation thereof when moving forward.
Figure 2B:
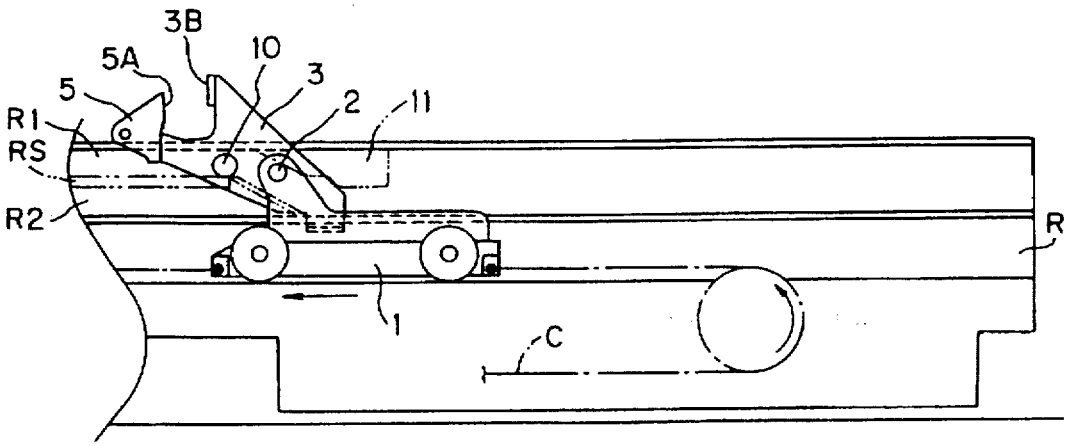
Figure 3A:
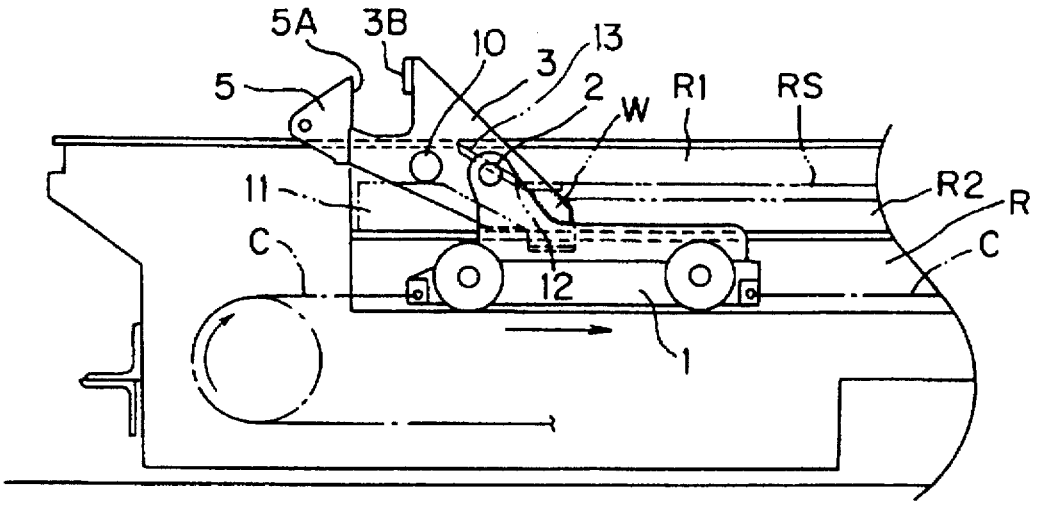
FIGS. 3(A) and (B) are fragmentary front views of a reciprocating guide rail of the pusher dog as shown in FIG. 1 which are useful in explaining the operation thereof when returning.
Figure 3B:
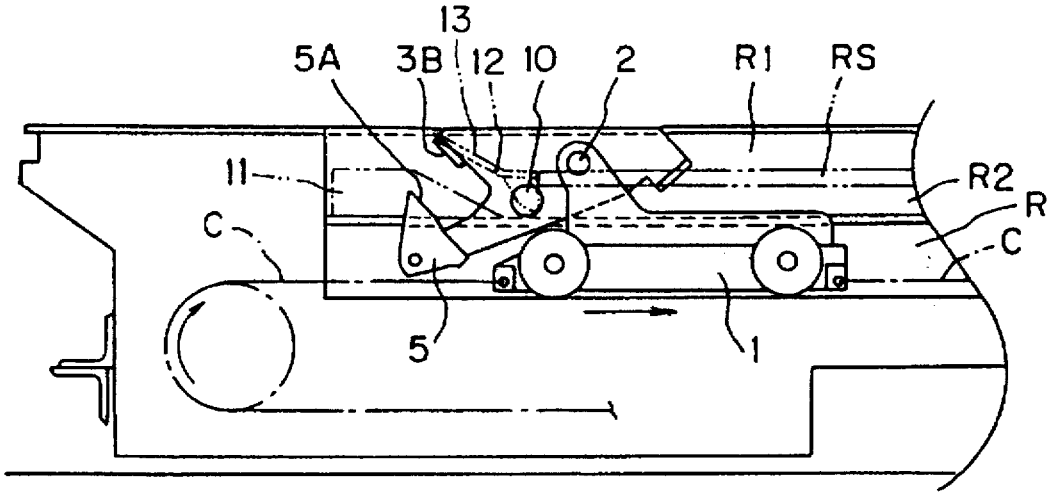
Figure 4:
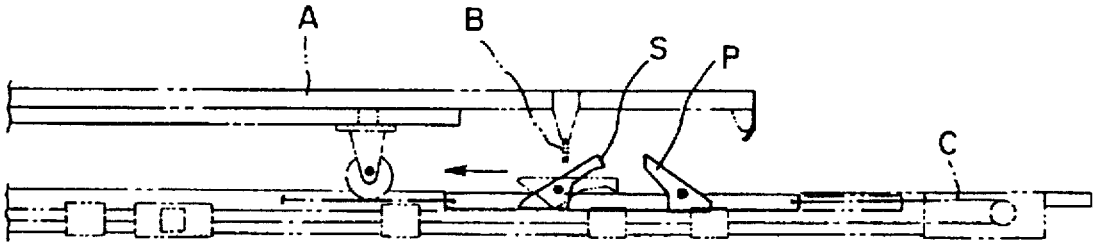
FIG. 4 PRIOR ART
FIG. 4 is prior art showing a schematic front view of the conventional pusher conveyor.

FIG. 2 and FIG. 3 are explanatory diagrams of the reciprocating guide rail of the pusher dog as shown in FIG. 1 in an operating condition. FIG. 2(A) shows a retreat limit of the pusher dog, and FIG. 2(B) shows a forward starting end thereof. FIG. 3(A) shows an advance limit of the pusher dog, and FIG. 3(B) shows a backward starting end thereof.

On the running guide rail R, a divisional rail RS is sandwiched in between a forward standing rail R1 mounted thereon and a backward prostrate rail R2 mounted thereunder. As shown in FIG. 2 (A), a pivotal shaft 9 of a switch rail 8 is mounted on the divisional rail RS at a starting end thereof, wherein a free end of the switch rail 8, by means of its own weight, abuts against the running surface of the backward prostrate rail R2.

When a cam roller 10, mounted on a side surface of the pusher dog 3 which is advancing in the direction of the arrow and guided by a standing position preventing cam 11, runs onto the switch rail 8 and enters the forward standing rail R1, the cam roller 10 is released from the standing position preventing cam 11, so that the pusher dog 3, as shown in FIG. 2 (B), is made to stand and thrusts the conveyor truck A.

As shown in FIG. 3 (A), a pivotal shaft 12 of a switch rail 13 is mounted on the divisional rail RS at a terminal end thereof, wherein a free end of the switch rail 13, urged by a weight W, abuts against the upper surface of the forward standing rail R1. The cam rail 10, pushing down the switching rail 13, reaches the advance limit of the pusher dog and thrusts the conveyor truck forward. Since the switching rail 13, over which the cam roller 10 has passed, closes the forward rail R1 by means of the foregoing urging force, when the pusher dog 3 retreats as the drive chain C moves in a reverse direction, the cam roller 10, guided by the back surface of the switch rail 13, enters the backward prostrate rail R2, disposed at the lower side of the divisional rail RS, so that the pusher dog 3, as shown in FIG. 3 (B), prevented from standing by the cam roller 10 thereby maintaining the prostrate position, returns to the start end position, as shown in FIG. 2(A), and thereafter the foregoing cycle illustrated as FIG. 2 (A), (B), and FIG. 3 (A), (B) is reiterated, thereby sequentially sending in the conveyor truck A.

It is noted that if a buffer, such as rubber, is mounted on the thrust surface 3B of the pusher dog 3, shock absorption and sound absorption during the collision with the pusher dog engaging plate B can be improved.

As will be understood from the foregoing, according to the present invention, unlike the prior art wherein the pusher dog and retainer dog are independently mounted on the chain, because the retainer dog 5 is mounted on the pusher dog 3 at the front portion thereof, when the pusher dog 3 tilts, the retainer dog 5 is tilted therewith. Accordingly, it is only necessary that the distance between the thrust surface 3B and the retainer surface 5A be a space large enough so that the retainer dog 5 can rotate with a tilting radius and so that the distance therebetween can be reduced as soon as possible. In this way, pulsation of the conveyor truck, caused by the collision between the pusher dog engaging plate B and the thrust surface 3B of the pusher dog 3, can be decreased and eliminated in its early stages. Further, the present invention has the conspicuous advantages, for example, of the accuracy of the stopping position of the conveyor truck and improving on the prevention of noise.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A pusher conveyor having a pusher dog with a retainer, comprising:

a conveyor chain;

a pusher dog pivotally mounted on said conveyor chain, said pusher dog having a thrust surface normally perpendicular to the direction of movement of said conveyor chain and a front end portion;

a retainer dog pivotally mounted on said pusher dog at said front end portion thereon and normally urged to a standing position, said retainer dog having a retainer surface, wherein said retainer surface of said retainer dog normally faces said thrust surface of said pusher dog at a parallel distance.

2. A pusher conveyor having a pusher dog with a retainer as recited in claim 1, further comprising:

a cam roller on said pusher dog for swinging said pusher dog;

a forward standing rail for guiding said cam roller in a frontward direction;

a backward prostrate rail for guiding said cam roller in a backward direction; and switching rails for switching said cam roller's moving direction from a frontward to a backward direction and from a backward to a frontward direction at a retreat limit and an advance limit of said pusher dog, respectively, whereby said pusher dog's tilting posture is changed.

* * * * *